US006089998A

United States Patent [19]

O'Neal et al.

[11] Patent Number: 6,089,998

[45] Date of Patent: Jul. 18, 2000

[54] CENTER ELEMENT FOR HOCKEY PUCK

[76] Inventors: Keith James O'Neal, 2129 W. Richton Rd., Steger, Ill. 60475; Jeffrey A. Aiello, 718 Bradley St., Matteson, Ill. 60443

[21] Appl. No.: 09/023,070

[22] Filed: Feb. 13, 1998

[51] Int. Cl.[7] ..... A63B 71/00

[52] U.S. Cl. ..... 473/588

[58] Field of Search ..... 473/588, 589

[56] References Cited

U.S. PATENT DOCUMENTS

| | | | |
|---|---|---|---|
| 2,494,929 | 1/1950 | Colaluca | 473/588 |
| 3,675,928 | 7/1972 | Gentile | 473/588 |
| 4,078,801 | 3/1978 | White, Sr. | 473/588 |
| 4,940,441 | 7/1990 | Novinsky | 473/588 X |
| 5,207,720 | 5/1993 | Shepherd | 473/588 X |
| 5,275,410 | 1/1994 | Bellehumeur et al. | 473/588 |
| 5,284,343 | 2/1994 | Bigornia et al. | 473/588 X |
| 5,676,376 | 10/1997 | Valley | 473/588 X |
| 5,816,964 | 10/1998 | Ainslie et al. | 473/588 |
| 5,855,528 | 1/1999 | Aiello et al. | 473/588 |

FOREIGN PATENT DOCUMENTS

| | | | |
|---|---|---|---|
| 519145 | 6/1921 | France | 473/FOR 244 |
| 3512763 | 10/1986 | Germany | 473/FOR 229 |

*Primary Examiner*—Raleigh W. Chiu
*Attorney, Agent, or Firm*—Hill & Simpson

[57] ABSTRACT

A hockey puck for playing on a non-ice surface includes an outer ring within which is held a center element. The outer ring includes low friction sliding elements mounted therein. The center element is interchangeable to center elements of different weights, hardnesses and flexibility to vary the playing characteristics of the puck. Center elements with gaps between the center element and the outer ring or with additional weights or liquid are also provided.

26 Claims, 2 Drawing Sheets

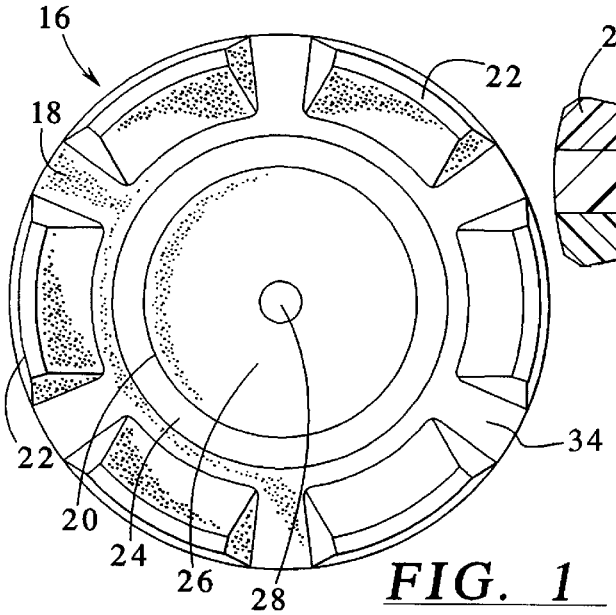
FIG. 1
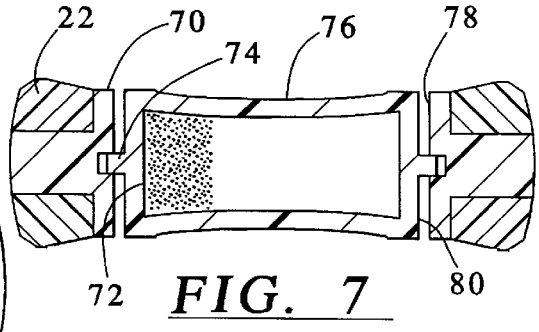
FIG. 7
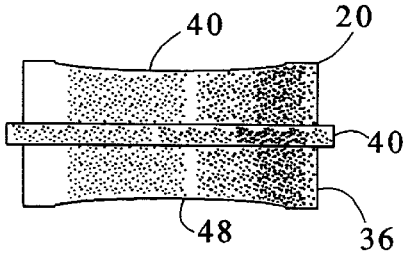
FIG. 3
FIG. 8
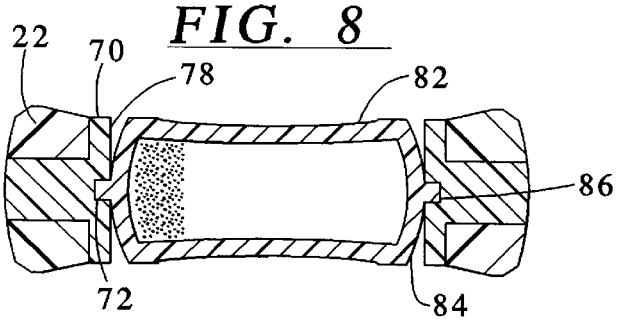
FIG. 9
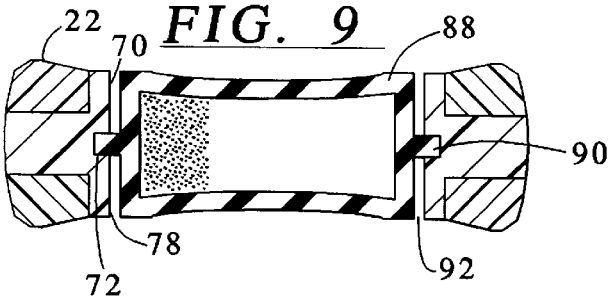
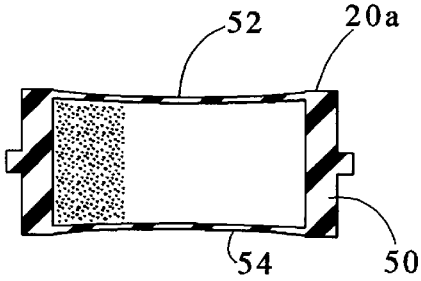
FIG. 4
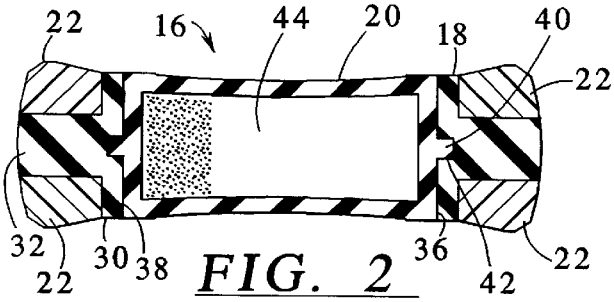
FIG. 2
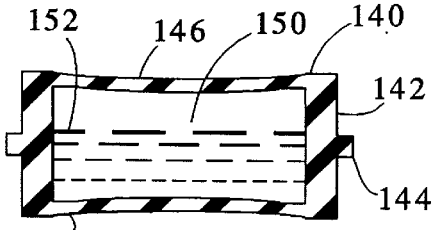
FIG. 14

CENTER ELEMENT FOR HOCKEY PUCK

BACKGROUND OF THE INVENTION

1. Field of the Invention

The present invention relates generally to a hockey puck and, more particularly, to a hockey puck for playing on a non-ice surface having a removable center element.

2. Description of the Related Art

While hockey is a sport which was initially played only on ice, it is increasingly being played on non-ice surfaces. The players may wear sport shoes or roller skates, although hockey played on a non-ice surface wearing in-line skates is preferred since they are more like ice skates. The non-ice playing surface maybe a street, parking lot, tennis court, gymnasium floor, roller rink, or a playing surface especially for roller hockey.

A variety of pucks have been tried for playing hockey on an non-ice surface. These pucks are generally in the form of a ball or a more traditional disk-shaped puck. An example of a puck for playing hockey on an non-ice surface is shown in U.S. Pat. No. 5,516,098. Another example is copending U.S. patent application Ser. No. 08/679,103, which is incorporated herein by reference. This puck includes a body formed of a resilient material and has slider members of a low friction material on at least the axial end faces of the puck. The sliding members permit the puck to slide over the non-ice surface while the resilient body absorbs shock and reduces bounce and vibration in the puck.

SUMMARY OF THE INVENTION

An object of the present invention is to provide a puck for playing hockey on an non-ice surface in which the playing characteristics of the puck can be varied by the user to suit the playing area.

Another object of the invention is to provide a hockey puck having a removable center element which is interchangeable with center elements of varying rigidity, weight and hardness to change the playing characteristics of the puck.

Yet another object of the invention is to match the playing characteristics of a hockey puck to various non-ice playing surfaces or to a style of play or skill level of the players.

A further object of the invention is to control bounce and weight in a hockey puck for use on a non-ice surface.

These and other objects and advantages of the invention are provided by a hockey puck having the general configuration of a shorten cylinder made up of an outer ring and a center element held in the ring. The two part construction of the hockey puck permits the outer ring and center element to be made of two different materials or of the same material, as desired. The center element is preferably removable from the ring so that center elements of different characteristics can be inserted into the ring to alter the playing characteristics of the puck. It is also within the scope of the present invention to provide the outer ring of a variety of different materials having different physical characteristics into which is inserted the center element.

An assortment of center elements are provided which are of different weights and/or different rigidities and/or different hardnesses. It is also within the scope of the invention to provide the center element of particular shapes and sizes to fit either loosely or tightly in the outer ring or with a gap or opening between the outer ring and the body of the center element. The interchangeable center elements permit the user to adjust the weight of the puck and/or the flexibility and/or the hardness of the puck so that the characteristics of the puck may be matched to the playing surface as well as to the playing style or skill level of the players.

Vibration dampening is also provided in the center element by inclusion of a weight suspended on one or more flexible elements or by inclusion of a liquid in the center element.

BRIEF DESCRIPTION OF THE DRAWINGS

FIG. 1 is a plan view of a hockey puck according to the principles of the present invention for play on a non-ice surface;

FIG. 2 is a cross-sectional view through the hockey puck of FIG. 1;

FIG. 3 is a side elevational view of a center element from the hockey puck of FIG. 1;

FIG. 4 is a cross-sectional view through a center element having thickened side walls according to another aspect of the invention;

FIG. 7 is a cross section through a hockey puck in which the center element is loosely positioned in the outer ring;

FIG. 8 is a cross section through a hockey puck having a center element with curved outer walls;

FIG. 9 is a cross section through a hockey puck with a gap between the center element and the outer ring except at an engagement rib;

FIG. 14 is a cross section through a center element including a quantity of liquid.

DESCRIPTION OF THE PREFERRED EMBODIMENTS

Figure 10:
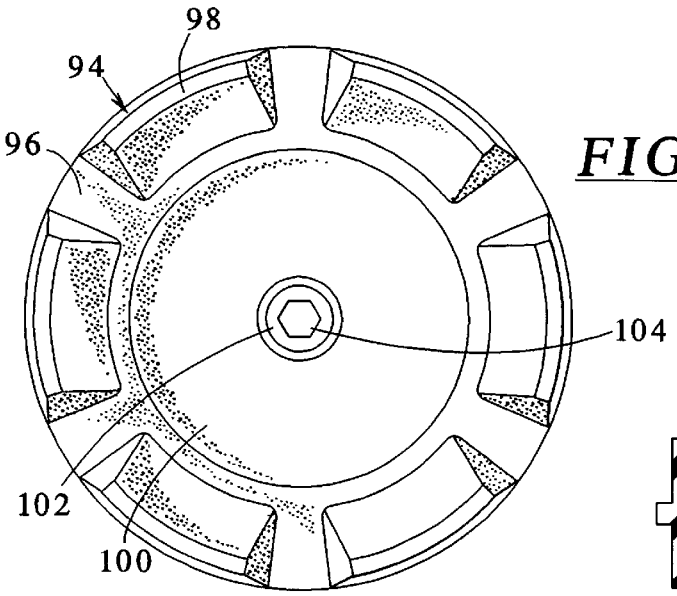
FIG. 10 is a plan view of a hockey puck according to the present invention which is provided with a center weight in the center element.

With reference first to FIG. 1, a hockey puck 16 is shown in plan view which includes an outer ring 18, a center element 20, and six slider members 22 on each of the top and bottom faces of the puck 16. The outer ring 18 has a circular outer profile and a circular inner opening in which is held the center element 20. The center element 20 has a circular outer profile matched to fit snugly in the circular opening in the outer ring in this embodiment. The end surface of the center element 20 which is visible in the FIG. 1 is concave and includes a generally planar outer ring-shaped area 24, a shallow sloping surface 26 and a center area 28 at the lower most part of the concave surface. The center area 28 is an artifact of manufacture in the illustrated embodiment and is not present in embodiments of the center element manufactured according to alternate processes. Specifically, the center element may be formed by injection molding, flow molding, or blow molding, for example.

The outer ring 18 and the center element 20 are of elastomeric material which is somewhat soft and flexible but has a relatively high coefficient of friction against a playing surface. The sliding members 22 are mounted in the outer ring at positions and an arrangement to contact the playing surface as the puck moves across the playing surface. The sliding members 22 are of an elastomeric material having a relatively lower coefficient of friction, although they are harder and less flexible than the material of the outer ring 18. The puck 16, thus, slides on the sliding members 22 during playing.

Referring now to FIG. 2, the cross section through the puck of FIG. 1 shows the sliding members 22 at the upper and lower peripheral surfaces of the puck 16 supported in the outer ring 18. The outer ring includes a cylindrical sleeve 30 from which extends a thickened ridge 32 which extends between the sliding members 22 to the outer perimeter of the puck 16. The sliding members 22 are fastened in the thickened ridge by a post and sleeve on each sliding member that extends through a pair of openings in the thickened ridge to cooperatively engage a corresponding post and sleeve on the opposing sliding member, as shown in copending U.S. patent application Ser. No. 08/679,103, which is incorporated herein by reference. The outer ring includes spacers 34 as shown in FIG. 1 between the slider members 22. The spacers 34 extend to the height of the sleeve 30 and out to the outer edge of the thickened ridge 32 between the slider members 22.

The center element 20 is snugly engaged at its outer wall 36 against an inner wall 38 of the outer ring 18. In the embodiment of FIGS. 1 and 2, no gap exists between the center element 20 and the outer ring 18. An engagement rib 40 extends from the outer cylindrical surface 36 of the center element 20 and engages into an engagement slot 42 in the cylindrical inner wall 38 of the outer ring 18. Since both the outer ring 18 and the center element 20 are of flexible elastomeric material, the center element 20 can be removed from the outer ring 18 by forcibly pressing against the top or bottom surface thereof. A different center element 20, for example a harder or softer center element, may be inserted into the outer ring 18.

The center element 20 of the present invention controls somewhat the degree of flex and vibration dampening of the puck. In the embodiment illustrated in FIG. 2, the center element 20 is hollow and includes a central space 44 surrounded by walls of the flexible material. The flexibility of the center element is determined primarily by the walls about the hollow interior. When the puck is struck by a hockey stick or when the moving puck strikes the playing surface, a boundary for the playing surface, a hockey stick or some other surface, the outer ring flexes and transfers some of the flexing force to the center element. The axial walls of the center element flex and so the top and bottom walls of the center element 20 are slightly concaved to enable the center element to flex without contacting the playing surface.

In the illustrated embodiment, the outer ring 18 and the center element are both of a material having a durometer of 90. Harder or softer outer rings and center elements are provided to be interchangeable with one another to permit a user to assemble a softer outer ring with a firmer center element, a harder outer ring with a softer center element or even a hard outer ring with a hard center element or a soft outer ring with a soft center element. The material of which the two parts are formed primarily determines the hardness of the puck.

FIG. 3 shows the center element 20 with the cylindrical outer wall 36 and single engagement rib 40 at the midline of the wall 36. While a single engagement rib 40 is shown, it is also contemplated to provide a plurality of engagement ribs arranged axially spaced along the wall, or intermittent ribs circumferentially spaced along the wall, or other means for engaging the center element in the outer ring. For instance, the engagement rib may be on inside surface of the outer ring and a corresponding engagement slot provided on the outer cylindrical surface of the center element.

The center element 20 may be formed by molding two identical halves divided along the horizontal midline relative to FIG. 3, each with one half of the engagement rib 40, and then performing a spin weld to fasten the two halves together. Alternately, a rotational mold, blow mold or injection mold process may be used to form the center element in one or more pieces. The center element 20 is relatively simple in shape so that manufacturing costs therefor are relatively low. It is thus easy and inexpensive to provide a plurality of center elements of different materials having differing weights, hardnesses, and flexibility. It is also inexpensive to provide the center element in different colors to match, for example, the team colors of a favorite hockey team or to contrast with the playing surface. The top and bottom axial surfaces 46 and 48 of the center element also provide a surface for marking logos or other images. As shown in the figure, the top and bottom surfaces 46 and 48 are concave to encourage flexing inward as the center element 20 aids in shock absorption for the puck.

A significant feature of the present hockey puck is that a single outer ring 18 with its mounted slider elements 22 may be provided with a variety of center elements 20 of different weights and hardnesses. For example, a lighter puck is desirable for greater speed during play but a heavier puck is required to control bouncing when play is conducted on a rough surface. Likewise, a harder puck is preferred for use on smooth playing surfaces while a softer puck is required for play on rough surfaces to absorb the shutter and bounce of the puck on the playing surface. A center element **20*a* is shown in FIG. 4 having an increased weight as compared to the center element 20 of FIG. 2 by virtue of thickened circumferential walls 50. The axial walls 52 and 54 are relatively thinner for flexibility in absorbing the forces exerted on the puck. The walls 52 and 54 may be the same thickness as corresponding walls of the center element shown in FIG. 2 or may be thinner as illustrated in FIG. 4 for greater flexibility. The outside dimensions of the center element 20*a* are the same as for the center element 20 so that the center element 20*a* may be placed into the outer ring to replace the center element 20** and thereby increase the weight of the puck.

Figure 5:
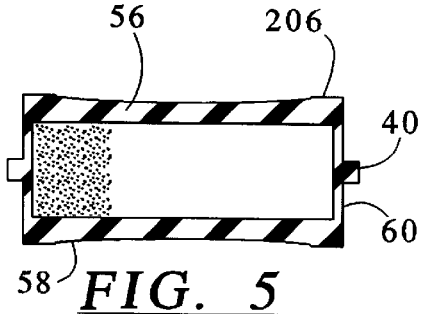
FIG. 5 is a cross section through a center element having thickened end faces according to further aspect of the invention.

FIG. 5 shows an embodiment of a center element **20*b* providing an alternative means to change the weight. In particular, the axial walls 56 and 58 are thick while the circumferential walls 60 are relatively thinner. The center element 20, 20*a* and 20*b*** may be made heavier or lighter by thickening or thinning either its axial walls or its circumferential walls, or both.

Figure 6:
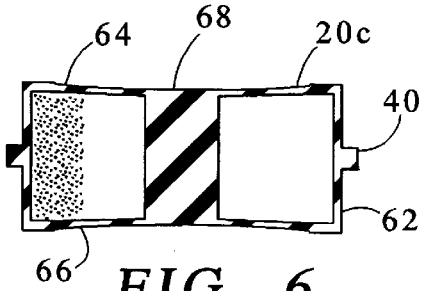
FIG. 6 is a cross section through another center element having a central post.

FIG. 6 illustrates yet another embodiment of a center element **20*c* having relatively thinner circumferential walls 62 and axial walls 64 and 66 and including the added element of a center post 68. The center post 68 not only increases the weight of the center element 20*c* and results in a heavier puck overall but also provides a vibration dampening effect on the puck movement. In particular, the center post 68, due to its mass, resists acceleration and deceleration of the puck and exerts elastic forces on the axial walls 64 and 66** as it moves relative to the rest of the puck.

In FIG. 7 is shown a cross section of a variation on the present hockey puck. In the embodiment of FIG. 7, the sliders 22 are mounted in an outer ring 70 of a harder material than the previously illustrated outer ring. The outer ring includes the engagement channel 72 in which is held an engagement rib 74 of a center element 76, which is also of a harder material than previously illustrated. The outer ring 70 has an inner cylindrical wall 78 that is of a greater diameter than the outer cylindrical wall 80 of the center element 76. The diameter of the engagement channel 72 is also greater than the diameter of the engagement rib 74. The center element 76 is thus able to move freely in a transverse direction within the outer ring 70 yet without being dislodged from the outer ring 70 during play. Not only does the transverse movement of the center element 76 absorb some of the energy which would otherwise result in the puck bouncing during play, but also the gap between the walls 78 and 80 provide space for the outer ring 70 to flex before engaging the center element 76. Although illustrated with harder materials, a mix of hard and soft materials or all softer materials may be used for the outer ring 70 and center element 76 in the embodiment shown in FIG. 7.

FIG. 8 is a cross section through a hockey puck according to yet another embodiment of the invention, wherein the outer ring 70 and slider elements 22 are generally as shown in FIG. 7 but a center element 82 having convex perimeter walls 84 which is provided in the outer ring 70. An engagement rib 86 is held in the engagement channel 72 with no freedom of transverse movement. However, the circumferential wall 84 of the center element 82 slopes away from the inner wall 78 of the outer ring to define a gap therebetween. The gap provides space for flexing of the outer ring 70 before fall engagement of the inner wall 78 against the center element 82. In other words, the circumferential wall 84 of the center element 82 flexes inwardly for a distance prior to the inner wall 78 of the outer ring engaging the axial walls of the center element 82. A stepped resistance flexing is thereby provided for the puck.

In FIG. 9, the outer ring 70 with the slider elements 22 has mounted therein a center element 88 which has an engagement rib 90 that is of a diameter corresponding to the diameter of the engagement channel 72. An outer wall 92 of the center element is of a lesser diameter than the inner wall 78 of the outer ring 70. A gap is thereby defined between the walls 92 and 78. Due to the matching diameters of the engagement channel and engagement rib, no transverse movement of the center element 88 within the outer ring 70 is possible in this embodiment. As described above, the outer ring may flex inwardly for the distance of the gap before engaging the center element fully. FIG. 9 also illustrates the mixing of a harder material for the outer ring 70 and a softer material for the center element 88.

The center elements described in foregoing have all been of a single material in a single piece. It is also within the scope of the present invention to incorporate an additional material into the center element to vary the weight or other playing characteristics of the puck. For example, in FIG. 10 is shown a hockey puck 94 having an outer ring 96 with slider elements 98 and a center element 100 secured in the outer ring 96. The center element 100 is cylindrical in shape and at its axis includes a weight 102. The weight 102 in the illustrated embodiment includes a hexagonal opening 104 within which may be engaged an Allen wrench.

Figure 11:
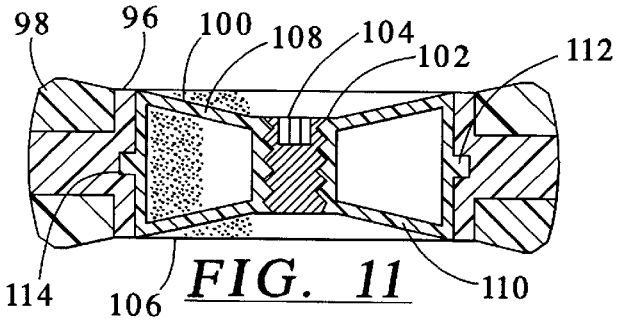
FIG. 11 is a cross-sectional view through the hockey puck of FIG. 10.

FIG. 11 shows a cross-sectional view of the puck of FIG. 10 in which can be seen the threaded engagement of the weight 102 and a threaded bore 106. The outer surface of the weight 102 is correspondingly threaded to hold securely in the threaded bore 106. The weight 102, which is in the shape of a set screw, permits the user of the present puck to vary the total weight of the puck by removing or inserting the weight 102 or by replacing the weight 102 with a similarly sized weight of a lighter or heavier material, or one including a hollow interior or deeper or shallower hexagonal opening. During play, the weight at the center of the center element 100 causes axial walls 108 and 110 to flex such as when the puck moves over a bumpy surface or upon acceleration or deceleration. The axial walls 108 and 110 are concaved to a greater extent than in the center elements not containing a weight so that the weight has room for movement. The embodiment shown in FIG. 11 of the center element 100 includes an engagement rib 112 and engagement channel 114 which permits the center element 100 to be removed, as desired. The center element may, optionally, be secured permanently in place in the puck.

Figure 12:
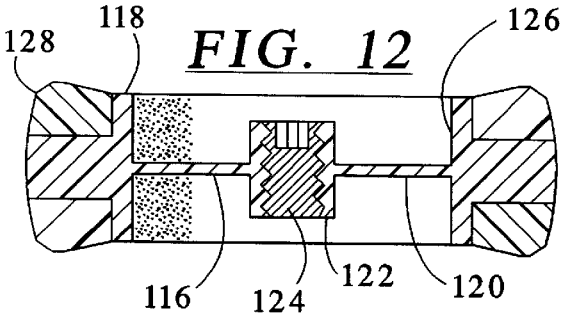
FIG. 12 is a cross-sectional view through a hockey puck having a center weight in another embodiment.

FIG. 12 illustrates an embodiment of the present puck wherein a center element 116 is permanently mounted within an outer ring 118 of the puck. The center element 116 includes a single wall 120 extending between a sleeve 122 having a center weight 124 and an inner wall 126 of the outer ring 118. Two such walls are also contemplated in an alternate embodiment. The outer ring 118 includes the slider elements 128 as described in the preceding embodiments and includes the threaded set screw like center weight 124 as in the embodiment of FIG. 11. The single wall 120 supporting the center weight 124 provides greater flexing movement of the center weight within the puck. However, the lack of axial walls extending from the axial ends of the inner wall 126 of the outer ring 118 provides a space for a hockey stick, for example, to catch on the puck. It is preferred that the center element include the axial walls shown in with FIGS. 1–11 to prevent catching of the hockey stick in a center portion of the puck.

Figure 13:
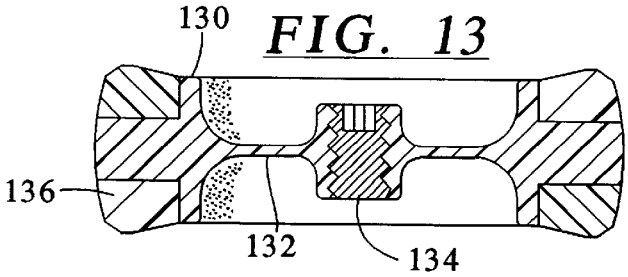
FIG. 13 is a cross section through another embodiment of a hockey puck having a center weight.

In the embodiment shown in FIG. 12, a flexing stress point occurs at the junction between the wall 120 and the inner wall 126 of the outer ring. To avoid this, an embodiment as shown in FIG. 13 has been developed including an outer ring 130 within which is formed a center element 132 having a wall of varying thickness to distribute the flexing stresses which result by movement of a center weight 134 at the center of the puck. The center weight 134 is threaded as in the embodiments of FIGS. 11 and 12 and the puck is also provided with sliders 136 as described above. The wall supporting the center weight 134 has a relatively large radius of curvature that also controls the movement of the weight 134.

A center element 140 is shown in FIG. 14 which includes not only the cylindrical wall 142 with an engagement rib 144 as well as axial walls 146 and 148 enclosing a hollow interior 150 but also includes a liquid 152 enclosed within the hollow interior 150. The liquid acts as a shock absorbing medium to reduce bounce and vibration in the puck.

Thus, there are shown and described various embodiments of a hockey puck for play on a non-ice surface according to the principles of the present invention. The puck enables the user or other individual to vary the weight of the puck and the hardness or flexibility of the puck by changing the center element in a common outer ring or by changing the outer ring around a common center element. The center element is of a simple, easily manufacturable shape enabling a variety of center elements to by provided inexpensively. A player using the present puck is able to vary the playing characteristics, such as the weight, flexibility, hardness and dampening means, of the puck to match the playing surface or the players' skill level or preference. The present puck controls the bouncing of the puck which occurs as the puck moves across the playing surface, as the puck strikes the boundary, and as the puck strikes a stick during passing or is struck by the stick during play. The control of the bouncing by the puck provides improved handling of the puck and play is more like that of a puck on ice. The center element, being a cylindrical shape and being symmetrical about a center axis, provides equal compression from any circumferential direction, no matter where the point of impact. The playing characteristics are therefore more predictable.

It is contemplated that the puck of the present invention may be provided with an outer ring not containing the sliders as illustrated, or with sliders or other friction reducing means of a different shape or construction.

The present puck enables the player to have the desired characteristic of the maximum hardness and rigidity in a hockey puck to transfer as much energy and speed to the puck during shooting and play, such as during a slap shot, while the user can adjust the weight, flexibility and hardness of the puck to accommodate rougher playing surfaces. For example, during a slap shot, the power imparted on the puck comes not only from a strong swing but also from flexing of the hockey stick. A player performing a slap shot swings and hits the ground just behind the puck, causing the stick to flex. As the player follows through, the stick unflexes and releases the built up energy which is transferred to the puck. During the slap shot, the puck compresses when hit by the stick. The softer materials compress and stay compressed all the way through the swing and absorb a great deal of the energy of the slap shot. Harder materials compress less and transfer more of the slap shot energy to the puck. The present puck provides the ability to vary the compression and thus energy absorbing characteristics of the puck at the outer ring as well as separately at the center element. The present puck therefore is capable of being optimized to a players' skill level and style of play as well as to the playing surface conditions in which the game is being played. The color of the puck may be varied to coordinate with the color of a players clothes, to provide a contrasting color to the playing surface, to match the colors of a favorite team, or to indicate a hardness or weight characteristic of such components.

Although other modifications and changes may be suggested by those skilled in the art, it is the intention of the inventors to embody within the patent warranted hereon all changes and modifications as reasonably and properly come within the scope of their contribution to the art.

We claim:

1. A playing piece for use on a non-ice surface, comprising:

a hockey puck including:

an outer ring of a material of a first hardness;

a center element held in said outer ring to form a cylinder having a greater diameter than axial length, said center element being of a material of a second hardness, said first hardness of said outer ring being greater than said second hardness of said center element; and releasable engagement connection holding said outer ring and said center element together, said releasable engagement connection being selectively releasable to permit removal of said center element from said outer ring.

2. A playing piece as claimed in claim 1, wherein said center element is generally cylindrical and is hollow.

3. A playing piece as claimed in claim 1, wherein said releasable engagement means includes an engagement ridge at a periphery of said center element and an engagement channel at an inside surface of said outer ring, said engagement ridge being positioned in said engagement channel to hold said center element in said outer ring.

4. A playing piece as claimed in claim 1, further comprising:

slider elements fastened in said outer ring to project from said outer ring at least at axial surfaces of said outer ring.

5. A playing piece as claimed in claim 1, wherein said outer ring has a substantially cylindrical inner surface and said center element has a substantially cylindrical outer surface.

6. A playing piece as claimed in claim 5, wherein said substantially cylindrical inner surface fits snugly against said substantially cylindrical outer surface when said center element is held in said outer ring.

7. A hockey puck for use on a non-ice surface, comprising:

an outer ring;

a center element held in said outer ring to form a cylinder having a greater diameter than axial length; and a releasable engagement connection holding said outer ring and said center element together, said releasable engagement connection being selectively releasable to permit removal of said center element from said outer ring, said outer ring having a substantially cylindrical inner surface and said center element has a substantially cylindrical outer surface, wherein said substantially cylindrical inner surface is spaced by a gap from said substantially cylindrical outer surface when said center element is held in said outer ring.

8. A hockey puck as claimed in claim 7, wherein said releasable engagement means includes:

an engagement ridge at a periphery of said center element, an engagement channel at an inside surface of said outer ring, said engagement ridge being in said engagement channel to hold said center element in said outer ring, said engagement channel being of substantially a same diameter as a diameter of said engagement ridge so that said center element is substantially immovable relative to said outer ring in a transverse direction.

9. A hockey puck as claimed in claim 7, wherein said releasable engagement means includes:

an engagement ridge at a periphery of said center element, an engagement channel at an inside surface of said outer ring, said engagement ridge being in said engagement channel to hold said center element in said outer ring, said engagement channel being of a greater diameter than a diameter of said engagement ridge so that said center element is movable relative to said outer ring in a transverse direction.

10. A hockey puck for use on a non-ice surface, comprising:

an outer ring;

a center element held in said outer ring to form a cylinder having a greater diameter than axial length; and releasable engagement connector holding said outer ring and said center element together, said releasable engagement connector being selectively releasable to permit removal of said center element from said outer ring, wherein said center element is hollow and further comprising:

a liquid in said hollow center element.

11. A playing piece as claimed in claim 1, further comprising:

a weight secured at a center of said center element.

12. A hockey puck for use on a non-ice surface, comprising:

an outer ring;

a center element held in said outer ring to form a cylinder having a greater diameter than axial length;

releasable engagement means for holding said outer ring and said center element together, said releasable engagement means being selectively releasable to permit removal of said center element from said outer ring; and a weight secured at a center of said center element, wherein said weight is threaded, and said center element defines a threaded opening to receive said weight.

13. A hockey puck for use on a non-ice surface, comprising:

an outer ring;

a center element held in said outer ring to form a cylinder having a greater diameter than axial length;

releasable engagement means for holding said outer ring and said center element together, said releasable engagement means being selectively releasable to permit removal of said center element from said outer ring; and a weight secured at a center of said center element;

wherein said center element includes at least one flexible wall extending between said weight and an inner wall of said outer ring.

14. A hockey puck as claimed in claim 13, wherein said at least one flexible wall is two flexible walls at axially opposite end faces of said center element.

15. A hockey puck as claimed in claim 13, wherein said at least one flexible wall is a single wall at an axial center of said puck.

16. A hockey puck for use on a non-ice surface, comprising:

an outer ring;

a center element held in said outer ring to form a cylinder having a greater diameter than axial length; and releasable engagement means for holding said outer ring and said center element together, said releasable engagement means being selectively releasable to permit removal of said center element from said outer ring;

wherein said outer ring is of a flexible material, said center element is a first center element of a material having a predetermined hardness, and further comprising:

a set of further center elements for selectively mounting in said outer ring in place of said first center element, ones of said set of further center elements being of hardnesses different from said predetermined hardness.

17. A playing piece as claimed in claim 1, wherein said outer ring is of a flexible material, said center element is a first center element of a material having a predetermined weight, and further comprising:

a set of further center elements for selectively mounting in said outer ring in place of said first center element, ones of said set of further center elements being of weights different from said predetermined weight.

18. A playing piece for use on a non-ice surface, comprising:

a hockey puck including:

an outer ring;

a center element in said outer ring to form a cylinder having a greater diameter than axial height; and a weight removably fastened in said center element, said weight being immovable in said center element when fastened therein.

19. A playing piece as claimed in claim 18, wherein said center element is selectively removable from said outer ring.

20. A playing piece as claimed in claim 18, wherein said center element is formed in one piece with said outer ring.

21. A playing piece as claimed in claim 18, wherein said center element is a single wall of a thickness in an axial direction less than a thickness in an axial direction of said outer ring, said center element being formed in one piece with said outer ring.

22. A playing piece for use on a non-ice surface, comprising:

a hockey puck including:

an outer ring having an inner ring surface;

a center element held in said outer ring to form a cylinder having a greater diameter than axial length, portions of said inner ring surface being free of said center element to permit said portions of said inner ring to flex inwardly at least a short distance without contact with said center element; and engagement connection holding said outer ring and said center element together.

23. A playing piece as claimed in claim 22, wherein said center element has an outer surface opposite said inner ring surface of said outer ring, said outer surface and said inner ring surface defining a gap therebetween.

24. A playing piece as claimed in claim 23, wherein at least one of said outer surface and said inner ring surface is curved away from said other of said outer surface and said inner ring surface to define said gap.

25. A playing piece as claimed in claim 22, wherein said center element is a disk of a thickness in an axial directed less than a thickness in an axial direction of said outer ring, said center element being positioned midway between opposite axial surfaces of said outer ring, and said inner ring surface of said outer ring is free of said center element above and below said center element.

26. A hockey puck for use on a non-ice surface, comprising:

an outer ring;

a center element held in said outer ring to form a cylinder having a greater diameter than axial length;

releasable engagement means for holding said outer ring and said center element together, said releasable engagement means being selectively releasable to permit removal of said center element from said outer ring; and a weight secured at a center of said center element;

wherein said center element includes at least one rigid wall extending between said weight and an inner wall of said outer ring.

* * * * *